US009586421B2

(12) United States Patent
Ito et al.

(10) Patent No.: US 9,586,421 B2
(45) Date of Patent: Mar. 7, 2017

(54) INKJET RECORDING DEVICE

(71) Applicant: MIMAKI ENGINEERING CO., LTD., Nagano (JP)

(72) Inventors: Shin Ito, Nagano (JP); Tomohiro Takano, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/902,335

(22) PCT Filed: Jul. 7, 2014

(86) PCT No.: PCT/JP2014/068028
§ 371 (c)(1),
(2) Date: Dec. 30, 2015

(87) PCT Pub. No.: WO2015/005268
PCT Pub. Date: Jan. 15, 2015

(65) Prior Publication Data

US 2016/0152051 A1 Jun. 2, 2016

(30) Foreign Application Priority Data

Jul. 8, 2013 (JP) ..... 2013-142803

(51) Int. Cl.
*B41J 13/00* (2006.01)
*B41J 11/00* (2006.01)
(Continued)

(52) U.S. Cl.
CPC ..... *B41J 13/0009* (2013.01); *B41J 11/003* (2013.01); *B41J 11/0045* (2013.01);
(Continued)

(58) Field of Classification Search
None
See application file for complete search history.

(56) References Cited

U.S. PATENT DOCUMENTS

2008/0192076 A1* 8/2008 Suzuki ..... B41J 11/007 347/10

FOREIGN PATENT DOCUMENTS

JP 2006-281750 10/2006
JP 2009-086653 4/2009
(Continued)

OTHER PUBLICATIONS

Machine translation of JP 2009202491 A, Imoto, Shinji, "Image Formation Device", Sep. 10, 2009, Paragraphs 0034-0043, Fig. 10.*
(Continued)

*Primary Examiner* — Lisa M Solomon
(74) *Attorney, Agent, or Firm* — Jianq Chyun IP Office

(57) ABSTRACT

An inkjet recording device includes a movement unit configured to move a recording medium or a placement part for placing the recording medium thereon; a detection unit configured to continuously detect movement of the recording medium or the placement part; and a control unit configured to control the movement unit and the detection unit. The detection unit includes a gripping unit having a gripping part for gripping the recording medium or the placement part and a detection part for continuously detecting movement of the gripping unit. The gripping unit is configured to move in conjunction with the movement of the recording medium or the placement part by gripping the recording medium or the placement part by the gripping part. The control unit is configured to control the movement of the movement unit on the basis of a detection result by the detection part when the gripping unit is moved.

6 Claims, 6 Drawing Sheets

(51) Int. Cl.

| | |
|---|---|
| ***B41J 13/02*** | (2006.01) |
| ***B41J 11/42*** | (2006.01) |
| *B41J 11/44* | (2006.01) |

(52) U.S. Cl.

CPC ..... *B41J 11/42* (2013.01); *B41J 13/02* (2013.01); *B41J 11/004* (2013.01); *B41J 11/007* (2013.01); *B41J 11/44* (2013.01)

(56) References Cited

FOREIGN PATENT DOCUMENTS

| | | |
|---|---|---|
| JP | 2009-202491 | 9/2009 |
| JP | 2012-024932 | 2/2012 |

OTHER PUBLICATIONS

"International Search Report (Form PCT/ISA/210)", mailed on Sep. 30, 2014, pp. 1-3, with English translation thereof.

"Office Action of China Counterpart Application" with English translation, issued on Aug. 23, 2016, p. 1-p. 12.

"Office Action of Japan Counterpart Application" with English translation thereof, issued on Oct. 4, 2016, p. 1-p. 5.

* cited by examiner

A part

INKJET RECORDING DEVICE

CROSS-REFERENCE TO RELATED APPLICATION

This application is a 371 application of the International PCT application serial no. PCT/JP2014/068028, filed on Jul. 7, 2014, which claims the priority benefit of Japan application no. JP 2013-142803, filed on Jul. 8, 2013. The entirety of each of the above-mentioned patent applications is hereby incorporated by reference herein and made a part of this specification.

TECHNICAL FIELD

The disclosure relates to an inkjet recording device, and more particularly, to an inkjet recording device having a recording head configured to eject ink droplets and configured to eject the ink droplets from the recording head and to make a record on a recording medium.

BACKGROUND ART

A variety of inkjet recording devices (inkjet printers) configured to eject an ink from nozzles of an inkjet head (recording head) and to record (print) desired character and figure on a recording medium have been known.

In the inkjet recording device, a variety of conveyance mechanisms configured to convey the recording medium have been adopted. For example, a belt conveyance mechanism has a configuration where a flexible endless belt configured to convey a medium such as a fabric, and a sheet is put on a pair of rollers, the rollers are rotated to move the belt by a driving motor and the recording medium is thus conveyed.

As another example, when a roll-shaped recording medium is used, the roll-shaped recording medium is fed from a feeding roller and is conveyed with being wound on a winding roller without using a belt for conveyance.

In the belt conveyance, regarding an actual movement amount (feed amount) of the belt, a deviation from a designated feed amount occurs due to the eccentricity of the roller and the non-uniformity in a thickness of the belt. Therefore, a technology of providing a rotary encoder configured to detect rotation of the roller, detecting an actual movement amount and correcting a driving signal of the motor by a detection signal thereof has been suggested.

For example, a belt device disclosed in Patent Document 1 has been known as the technology of correcting the eccentricity variation of the roller and the thickness variation of the belt upon the conveyance of the recording medium. The belt device includes a first roller, which is a driving roller, a second roller, which is a driven roller, an endless belt put between the first roller and the second roller, and a facing roller provided to face the first roller with the belt being interposed therebetween. The first roller and the facing roller are respectively provided with rotary encoders. According to this configuration, the thickness variation of the belt and the eccentricity variations of the first roller and facing roller, which are detected by the rotary encoders provided for the first roller and the facing roller, are stored, and the driving signal of the driving motor is corrected on the basis of the variation components thus recorded, so that the first roller is rotated to reduce the variation in a moving speed or movement distance of the belt.

PRIOR ART DOCUMENT

Patent Document

Patent Document 1: JP-A-2009-086653

SUMMARY OF THE INVENTION

Technical Problem

However, according to the configuration exemplified in Patent Document 1, both ends of the belt are coupled, so that an annular structure is formed as a whole. For this reason, the endless belt has a seam, and the thickness variation of the belt at the seam is larger than the thickness variation of another part. The thickness variation of the belt, the slippage due to the surface roughness of the belt, the serpentine of the belt and the like cause an error in the detection values of the rotary encoders, so that it is difficult to obtain a correct movement amount.

Therefore, the disclosure is to accurately detect an actual movement amount of a recording medium without being influenced by the thickness variation, the slippage, the serpentine and the like of the recording medium or a belt configured to convey the recording medium. The disclosure also provides an inkjet recording device capable of precisely correcting movement of the recording medium on the basis of a detection value and accurately positioning the recording medium to which an ink is to be ejected from an inkjet head, thereby making a record of a high image quality.

Solutions to Problem

As an illustrative embodiment, the above problem are solved by following configurations.

An inkjet recording device having a recording head configured to eject ink droplets and configured to make a record on a recording medium by ejecting the ink droplets from the recording head is disclosed. The inkjet recording device includes a movement unit configured to move the recording medium or a placement part configured to place the recording medium thereon, a detection unit configured to continuously detect movement of the recording medium or the placement part, and a control unit configured to control the movement unit and the detection unit, wherein the detection unit includes a gripping unit having a gripping part configured to grip the recording medium or the placement part and a detection part configured to continuously detect movement of the gripping unit, wherein the gripping unit is configured to move in conjunction with the movement of the recording medium or the placement part by gripping the recording medium or the placement part by the gripping part, and wherein the control unit is configured to control the movement of the movement unit on the basis of a detection result by the detection part when the gripping unit is moved.

According to the inkjet recording device, the gripping unit is configured to grip the placement part by the gripping part, so that the gripping unit is moved in conjunction with the movement of the placement part. Therefore, a movement amount of the gripping unit is continuously detected by the detection part, so that it is possible to accurately detect a movement amount of the placement part. Since it is possible to accurately position the recording medium placed on the placement part at a correct position by correcting and controlling the movement of the movement unit on the basis of the detection value, it is possible to make a record of a high image quality.

In the meantime, the operational effects are not limited to the configuration where the recording medium is conveyed with being placed on the placement part, and can also be accomplished when the recording medium is directly conveyed without the placement part.

Also, according to the present invention, the ink jet recording device preferably includes a driving unit that is configured to drive the movement unit or the gripping unit, thereby generating a driving force for moving the placement part. According to this configuration, it is possible to move the recording medium or the placement part by driving the movement unit with the driving unit. Alternatively, the gripping unit may be driven by the driving unit, and the recording medium or the placement part may be moved with being gripped by the gripping part.

Also, according to the disclosure, preferably, the movement unit is a pair of rollers, and the placement part is a belt put on the pair of rollers. According to this configuration, it is possible to move the belt functioning as the placement part by driving the roller functioning as the movement unit. That is, in a configuration where the gripping unit is not driven, it is not necessary to make a structure of the gripping unit as a robust and complicated structure in which the transmission of the driving force is premised. Therefore, the structure can be simplified. Further, if the gripping unit is driven to move the placement part, slippage occurs due to the load at a part gripped by the gripping part, so that the detection accuracy may be lowered. However, according to the above configuration, the driving force of the driving unit is transmitted to the movement unit and the gripping unit is configured to move in conjunction with the movement of the placement part. That is, the driving configuration and the conjunction moving configuration can be functionally separated. Therefore, since the gripping unit can be configured only to detect the movement amount without performing the driving, it is possible to improve the accuracy of the detection value.

Advantageous Effects of Invention

According to the disclosed inkjet recording device, it is possible to accurately detect the actual movement amount of the recording medium without being influenced by the thickness variation, the slippage, the serpentine and the like of the recording medium or the belt configured to convey the recording medium. Therefore, since it is possible to precisely correct the movement of the recording medium on the basis of the detection value, it is possible to accurately position the recording medium to which the ink is to be ejected from the inkjet head, thereby making a record of a high image quality.

DESCRIPTION OF EMBODIMENTS (First Illustrative Embodiment)

Hereinafter, a first illustrative embodiment of the disclosure will be described in detail with reference to the drawings.

Figure 1:
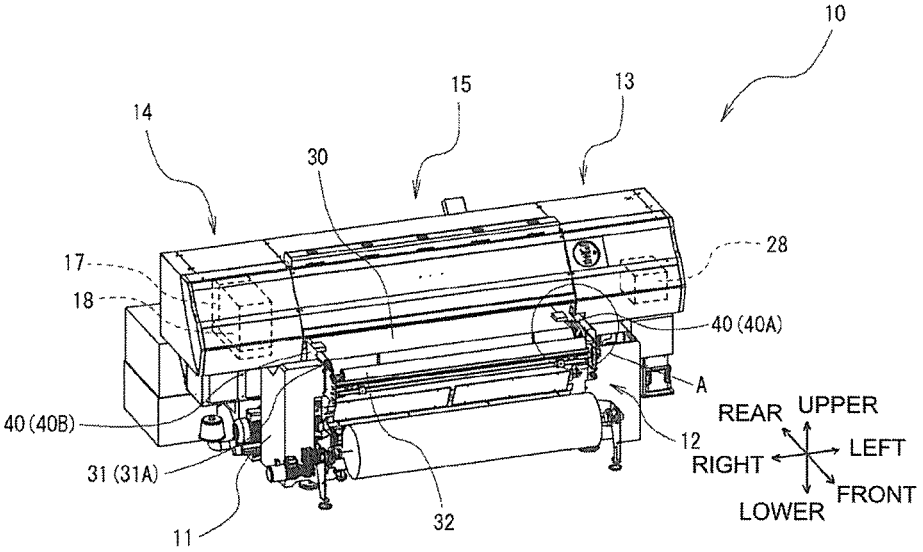
FIG. 1 is a schematic view depicting an example of an inkjet recording device of a first illustrative embodiment of the disclosure.
Figure 2:
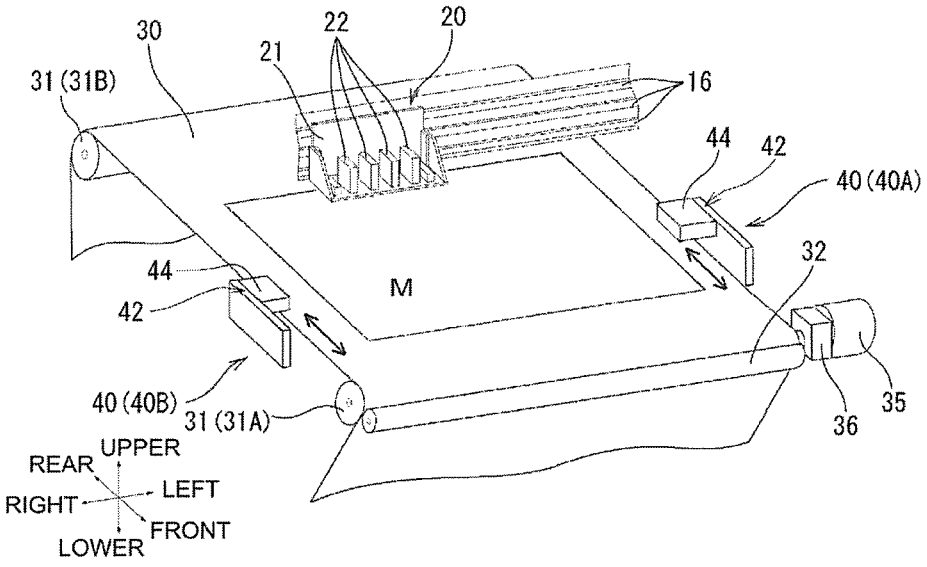
FIG. 2 is a schematic view depicting a surrounding of a head unit of the inkjet recording device of the first illustrative embodiment of the disclosure.

FIG. 1 is a schematic view (perspective view) of an inkjet recording device 10 of a first illustrative embodiment of the disclosure. FIG. 2 is a schematic view (perspective view) depicting a surrounding of a head unit 20 of the inkjet recording device 10. For convenience of explanations, front, rear, left, right, upper and lower directions of the inkjet recording device 10 are denoted by arrow directions in the respective drawings.

Meanwhile, in the drawings for illustrating the illustrative embodiments, the members having the same function are denoted by the same reference numerals, and the overlapping descriptions may be omitted.

The inkjet recording device 10 is a device configured to perform printing processing of characters, figures and the like by ejecting liquid (here, ink) from nozzles of a recording head (inkjet head) to a recording surface (printing surface) of a recording medium M such as a sheet, a fabric and a resin sheet (for example, vinyl chloride, polyester and the like). In the meantime, a variety of inks such as a UV ink, which is to be cured by ultraviolet (UV) irradiation, an aqueous ink such as an aqueous sublimation transfer ink, and a solvent ink may be used as the ink.

Here, the first illustrative embodiment is an example of the configuration where a movement unit (a pair of rollers) configured to move a placement part (here, the belt) on which the recording medium M is to be placed is provided.

The inkjet recording device 10 of the first illustrative embodiment has, as shown in FIGS. 1 and 2, a central body part 12 supported by a support leg 11, a left body part 13 provided at the left of the central body part 12, a right body part 14 provided at the right of the central body part 12, and an upper body part 15 configured to couple the left and right body parts 13, 14 and to extend in parallel with the central body part 12 above the central body part 12. The central body part 12 is provided with a pair of rollers (a first roller 31A and a second roller 31B) functioning as a movement unit 31 configured to move a placement part (here, the belt) 30. Also, detection units 40 configured to continuously detect movement of the belt 30 are provided (which will be described in detail later).

The left body part 13 is provided on a front surface thereof with operation switches and a display device, and has therein a right and left movement mechanism (not shown) configured to move the head unit 20 which will be described later (refer to FIG. 2) right and left, a maintenance station (not shown) configured to clean the head unit 20, and the like, a control unit 28 functioning as a control unit configured to control operations of the respective constitutional members, and the like.

Here, as shown in FIG. 2, the upper body part 15 has therein guide rails 16 extending right and left, and the head unit 20 is attached to the guide rails 16 so that it can reciprocally move right and left. The head unit 20 is configured to be driven by the right and left movement mechanism and to be conveyed right and left along the guide rails 16 in the upper body part 15.

Meanwhile, as shown in FIG. 1, the right body part 14 has therein a cartridge attachment part 17, and a plurality of cartridge-type ink tanks 18 is attached to the cartridge attachment part 17 so that they can be attached and detached from a front surface-side, for each ink color. The cartridge attachment part 17 has therein a connection part (not shown) configured to accommodate the ink tanks 18 and to introduce the inks. Ink tubes (not shown) provided in the right body part 14 and the upper body part 15 are coupled from the connection part to inkjet heads 22 (which will be described later) functioning as the recording heads, for each color, and the inks of the ink tanks 18 are to be supplied to the recording heads 22 through the ink tubes.

As shown in FIG. 2, the head unit 20 mainly has a cartridge 21 and the recording heads 22. The cartridge 21 is fitted to the guide rails 16 at a rear surface thereof and is configured to reciprocally move right and left along the guide rails 16. The recording heads 22 are configured for each color of magenta, yellow, cyan and black, for example, and a lower surface of each recording head is formed with a plurality of nozzles (not shown) configured to downwardly eject the ink.

Subsequently, the belt 30 functioning as the placement part and the pair of rollers 31A, 31B functioning as the movement unit are described.

As shown in FIGS. 1 and 2, in the first illustrative embodiment, the belt 30, which is an endless belt-shaped member, is put between the first roller 31A and the second roller 31B functioning as the movement unit 31, and the first roller 31A functioning as a driving roller and the second roller 31B functioning as a driven roller are driven to rotate, so that the belt 30 is circulated. Thereby, the recording medium M is conveyed with being placed on the belt 30 as the belt 30 is moved.

Here, the belt 30 has a structure where both ends of the long rectangular belt are processed to have a finger shape and an adhesive sheet is laminated thereon with the both ends being contacted. For this reason, the belt 30 has a strip-shaped seam having a constant width in a direction perpendicular to a conveying direction. A thickness of the seam is thicker than the other parts.

A rotary shaft of the first roller 31A is coupled to an electric motor 35 functioning as the driving unit via a transmission unit (here, gear) 36. Here, as a modified embodiment, the electric motor 35 and the rotary shaft of the first roller 31A may be directly coupled with each other or may be coupled via another transmission unit (for example, a driving belt) (not shown).

In the meantime, the driving unit is not limited to the electric motor such as a stepping motor, and other driving sources such as solenoid may also be used.

The electric motor 35 is configured to be driven under control of the control unit 28. In the first illustrative embodiment, detection signals of the detection units 40 (which will be described later), which indicate an actual movement amount of the belt 30, are input to the control unit 28. The control unit 28 is configured to correct a driving signal of the electric motor 35 on the basis of the detection signals, thereby controlling the movement of the movement unit 31 (here, the first roller 31A) so that the belt 30 put between the first roller 31A and the second roller 31B is moved with an accurate movement amount. In the meantime, as the electric motor 35, a stepping motor is used, for example.

Figure 3:
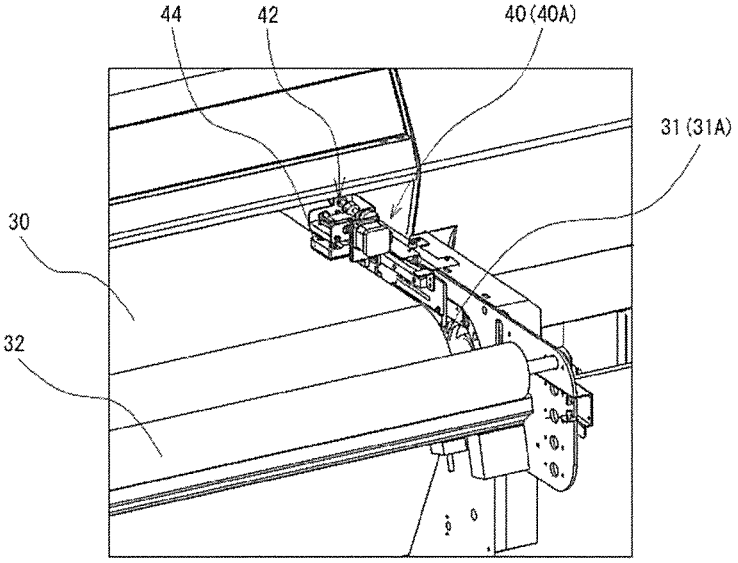
FIG. 3 is an enlarged view of an A part of FIG. 1.
Figure 4:
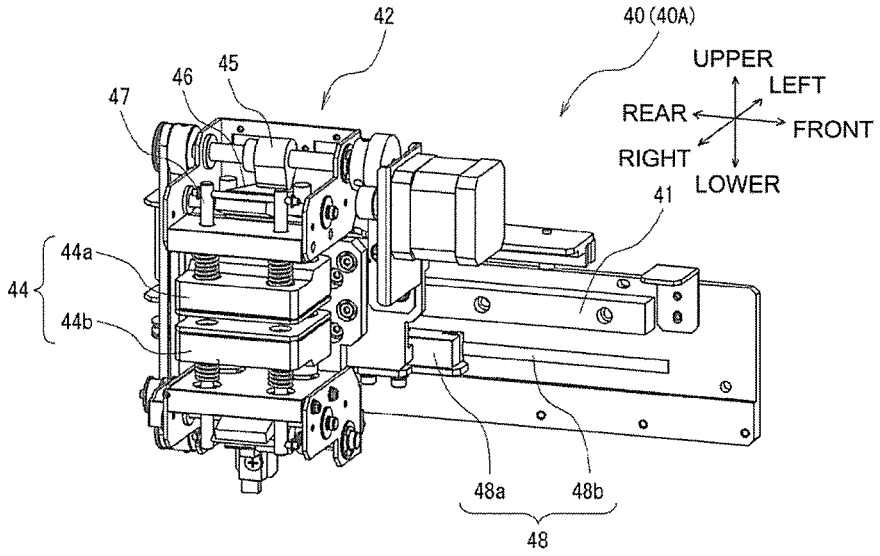
FIG. 4 is a schematic view depicting a detection unit of the inkjet recording device of the first illustrative embodiment of the disclosure.

Subsequently, the detection unit 40 that is the feature of the first illustrative embodiment is described with reference to FIGS. 2 to 4. Here, FIG. 3 is an enlarged view of a part (A part) of FIG. 1 to which the detection unit 40 is attached, and FIG. 4 is a schematic view (perspective view) of the detection unit 40. Meanwhile, in the first illustrative embodiment, two detection units 40 are disposed at right and left positions of the belt 30 so that the belt 30 is positioned therebetween. FIG. 4 depicts a configuration example of the left detection unit 40 (40A). In the meantime, the right detection unit 40 (40B) (not shown) is symmetrical to the left detection unit 40 (40A).

As shown in FIGS. 2 to 4, the detection unit 40 has a gripping unit 42 having a gripping part 44 for gripping the belt 30 and a detection part 48 configured to continuously detect movement of the gripping unit 42. Here, the gripping part 44 is configured to interpose the belt 30 therebetween in the upper and lower direction. Also, a linear-motion guide 41 for moving the gripping unit 42 back and forth is provided, so that the gripping unit 42 is configured to move back and forth in conjunction with the movement of the belt 30.

Here, the gripping part 44 has an upper grip 44*a* and a lower grip 44*b* arranged to be closely contacted and released in the upper and lower direction. As an example, the upper grip 44*a* is coupled to an operating pin 47 configured to move the upper grip 44*a* in the upper and lower direction and is configured to move in the upper and lower direction by moving one end portion of a clip part 46 coupled to the operating pin 47 in the upper and lower direction through rotation of a cam 45. The lower grip 44*b* has the substantially same configuration as the upper grip 44*a*, which is symmetric in the upper and lower direction. Therefore, when the upper grip 44*a* and the lower grip 44*b* are closely contacted to each other in the upper and lower direction, the belt 30 arranged to pass between the upper grip 44*a* and the lower grip 44*b* can be sandwiched and gripped.

According to the above configuration, when the movement unit 31 is driven to move the belt 30, the belt 30 is gripped with the gripping part 44 by a control signal from the control unit 28, so that the gripping unit 42 is moved back and forth in conjunction with the belt 30 being moved.

Also, when the gripping unit 42 is moved back and forth, the detection part 48 continuously detects the movement (the movement amount) thereof. More specifically, the linear scale functioning as the detection part 48 of the first illustrative embodiment has a head part 48*a* and a scale part 48*b*. By the linear scale 48, the movement (movement amount) of the gripping unit 42 in the front and rear direction is detected.

According to the above configuration, since the gripping unit 42 is moved back and forth in conjunction with the belt 30 with the belt 30 being gripped by the gripping part 44, it is possible to detect a movement amount of the belt 30 by detecting a movement amount of the gripping unit 42. In the first illustrative embodiment, since the detection can be performed by the linear scale 48, as described above, it is possible to accurately detect the movement amount of the belt 30, as compared to a detection mechanism of the related art such as an encoder.

More specifically, for example, according to the encoder detection mechanism of the related art, the endless belt has a seam, so that a thickness of the belt is not uniform. Therefore, an error of a detection value occurs due to the thickness variation of the belt. However, according to the first illustrative embodiment, since it is possible to detect the movement amount of the belt 30 by the linear scale 48, as the movement amount of the gripping unit 42, it is possible to solve the detection error as described above.

Also, a detection error due to the slippage, which occurs in the related art due to the surface roughness of the belt, can be solved by the configuration of the first illustrative embodiment where the gripping part 44 is moved in conjunction with the belt 30 with gripping the belt 30.

Further, a detection error, which occurs in the related art due to the serpentine of the belt, can be solved by the configuration of the first illustrative embodiment where the gripping part 44 is moved in conjunction with the belt 30 with gripping the belt 30 and the movement amount of the belt 30 is detected by the two right and left detection units 40A, 40B.

In this way, it is possible to accurately detect the actual movement amount of the belt 30 by the detection units 40. Therefore, it is possible to control the movement of the movement unit 31 (i.e., the driving of the electric motor 35) so that the belt 30 is located at a correct position, i.e., the recording medium M placed on the belt 30 is located at a correct position while precisely correcting the movement of the movement unit 31 (i.e., the driving of the electric motor 35) on the basis of the detection values. As a result, it is possible to make a record of a high image quality on the recording medium M.

In the first illustrative embodiment, since the linear scale is used as the detection part 48, a problem that a movement amount of the long distance cannot be detected should be considered. However, the movement amount to be detected is sufficient inasmuch as it is possible to detect a distance of one pass when performing the printing on the recording medium M. Therefore, the corresponding problem does not occur.

Subsequently, operations of the inkjet recording device 10 configured as described above are described.

Upon a normal printing, the inkjet recording device 10 is configured to downwardly eject ink droplets from the nozzles provided on the lower surfaces of the recording heads 22 to attach the ink droplets to the recording medium M in a desired pattern while reciprocally moving the head unit 20 right and left along the guide rails 16 relative to the recording medium M placed on the belt 30. When the printing on the recording medium M over a predetermined width in the front and rear direction is completed, the movement unit 31 (the first roller 31A, which is the driving roller, and the second roller 31B, which is the driven roller) is driven to slide the belt 30 back and forth and the ink droplets are ejected while again reciprocally moving the head unit 20 right and left. The corresponding operations are repeated, so that desired characters and figures are printed on the recording medium M over the entire printing area.

Here, the conveying operation of the recording medium M is described.

First, the electric motor 35 functioning as the driving unit is driven to rotate the first roller 31A, which is the driving roller. The first roller 31A, which is the driving roller, is driven to rotate, so that the belt 30 put between the first roller 31A, which is the driving roller, and the second roller 31B, which is the driven roller, is moved. Thereby, the recording medium M placed on the belt 30 is conveyed in conjunction with the movement of the belt 30. Meanwhile, in the first illustrative embodiment, the first roller 31A is the driving roller. However, the second roller 31B may be configured as the driving roller.

Here, the detection operation of the detection units 40 upon the movement of the belt 30 is described with reference to FIGS. 5A to 5C.

Figure 5A:
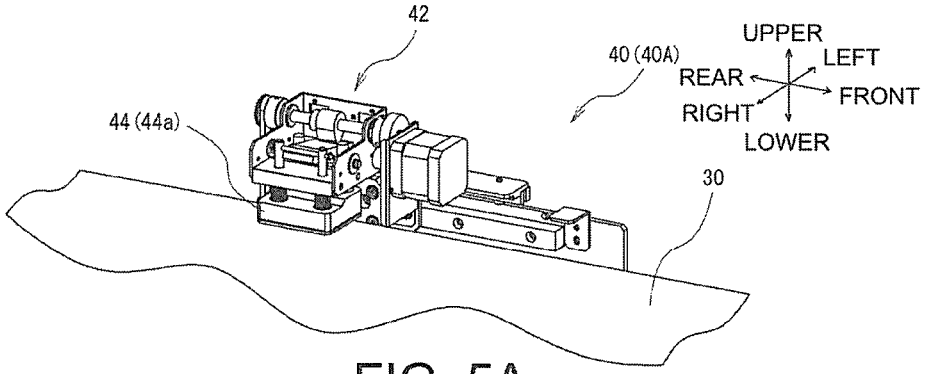
FIGS. 5A to 5C illustrate operations of the detection unit of the inkjet recording device of the first illustrative embodiment of the disclosure.
Figure 5B:
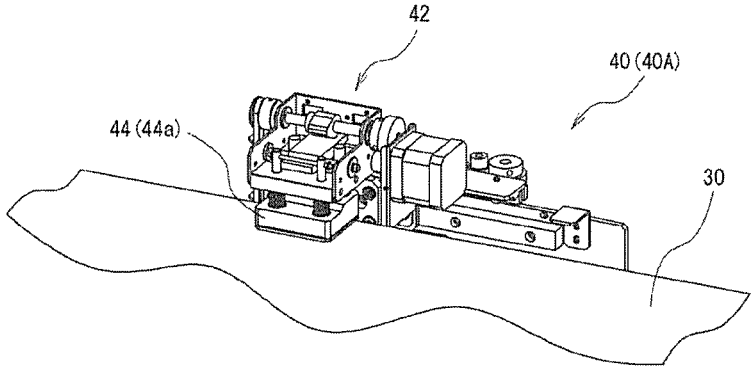
Figure 5C:
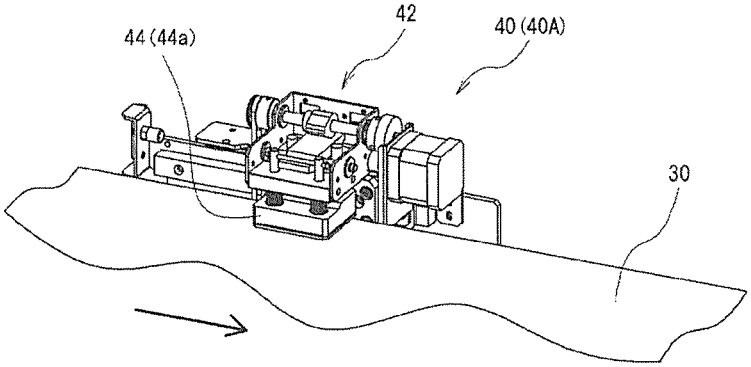

First, a state of the detection unit 40 (here, the left detection unit 40A) before the belt 30 is moved is shown in FIG. 5A. When the belt 30 starts to move, the belt 30 is gripped by the gripping part 44, as shown in FIG. 5B. The gripping operation is performed by bringing the upper grip 44*a* and the lower grip 44*b* into close contact with each other in the upper and lower direction. At this state, when the belt 30 starts to move, the gripping part 44, i.e., the gripping unit 42 having the gripping part 44 is moved in the same direction (front and rear direction in FIGS. 5A to 5C) as the movement direction of the belt 30 in conjunction with the movement of the belt 30 (refer to FIG. 5C).

In the meantime, the right detection unit 40 (40B) (not shown) also performs the same operations.

Here, the movement (driving) control on the basis of the detection value of the detection unit 40 is described.

First, when the belt 30 moves, the movement amount of the gripping unit 42, which is configured to move in conjunction with the belt 30, is continuously detected by the detection part 48 (here, the linear scale).

Then, based on the detection signal detected by the linear scale 48, the movement of the movement unit 31, i.e., the driving of the electric motor 35 is corrected and the belt 30 put between the first roller 31A and the second roller 31B is moved.

According to the first illustrative embodiment, as described above, since it is possible to accurately control the movement of the belt 30, it is possible to accurately position the recording medium M at the correct position to which the ink droplets are to be ejected. Therefore, as compared to the related art where the movement is corrected by detecting the movement amount with the rotary encoder and the like, since it is possible to considerably reduce an error to be included in the detection value of the actual movement amount, it is possible to remarkably improve the recording accuracy.

In the first illustrative embodiment, the movement unit 31 and the belt 30 are moved by transmitting the driving force of the driving unit (the electric motor 35) to the driving roller (the first roller 31A). Therefore, since the gripping unit 42 is not driven, it is not necessary to make the structure of the gripping unit 42 as a robust and complicated structure in which the transmission of the driving force is premised. That is, the structure can be simplified. Further, if the gripping unit 42 is driven to move the belt 30, the belt slips due to the load at a part gripped by the gripping part 44, so that the detection accuracy may be lowered. However, according to the above configuration, the driving force of the driving unit 35 is transmitted to the movement unit 31 and the gripping unit 42 is configured to move in conjunction with the movement of the belt 30. That is, the driving configuration and the conjunction moving configuration can be functionally separated. Therefore, since the gripping unit 42 can be configured only to detect the movement amount without performing the driving, it is possible to improve the accuracy of the detection value.

In the meantime, as a modified embodiment of the above configuration, the driving force may be transmitted to the gripping unit 42 through the transmission unit (for example, the driving belt), so that the gripping unit 42 is moved to move the belt 30.

(Second Illustrative Embodiment)

In the below, the inkjet recording device 10 of a second illustrative embodiment of the disclosure is described.

The second illustrative embodiment is an example of a configuration where the recording medium M is directly conveyed by a feeding roller configured to feed the recording medium M and a winding roller configured to perform a winding operation, without the placement part (for example, the belt of the first illustrative embodiment) on which the recording medium M is to be placed.

Therefore, the inkjet recording device 10 of the second illustrative embodiment has the same basic configuration as the first illustrative embodiment. However, while the recording medium M is conveyed with being placed on the belt 30 in the first illustrative embodiment, the recording medium M is directly conveyed in the second illustrative embodiment. In the below, the second illustrative embodiment is described with respect to the difference.

Figure 6:
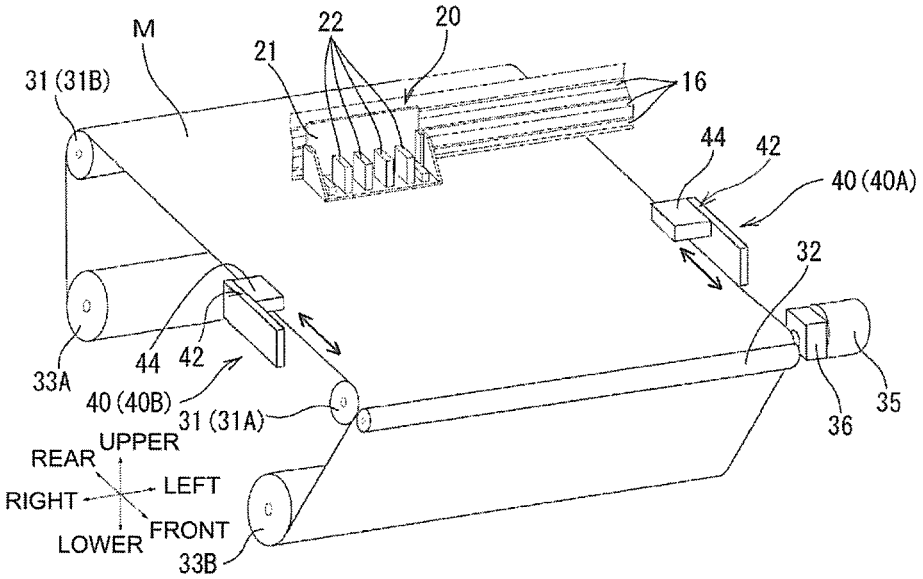
FIG. 6 is a schematic view depicting a surrounding of a head unit of an inkjet recording device of a second illustrative embodiment of the disclosure.

As shown in FIG. 6, according to the second illustrative embodiment, a feeding roller 33A on which the recording medium M before the recording is wound and a winding roller 33B on which the recording medium M after the recording is to be wound are provided. The recording medium M is to be fed from the feeding roller 33A, to be put on the pair of rollers (the first roller 31A and the second roller 31B) functioning as the movement unit 31, and to be wound by the winding roller 33B. Here, the reference numeral '32' indicates a pinch roller configured to interpose the recording medium M between the pinch roller and the driving roller (the first roller 31A). By this configuration, the driving force from the driving roller (the first roller 31A) is transmitted to the recording medium M, so that the recording medium is moved (conveyed).

In the second illustrative embodiment, when the recording medium is moved, the detection unit 40 enables the gripping part 44 to grip the recording medium M and detects the movement amount of the recording medium M.

Since the other configurations, the control method and the operational effects are the same as the first illustrative embodiment, the overlapping descriptions are omitted.

Meanwhile, in the second illustrative embodiment, the driving force from the driving unit (the electric motor 35) is transmitted to the driving roller (the first roller 31A), so that the recording medium M is moved. Therefore, like the first illustrative embodiment, it is possible to simplify the structure and to improve the detection accuracy by the configuration where the gripping unit 42 is not driven. In the meantime, as a modified embodiment, the driving force may be transmitted to the gripping unit 42 through the transmission unit (for example, the driving belt) to move the gripping unit 42, thereby moving the recording medium M.

According to the second illustrative embodiment having the above configuration, like the first illustrative embodiment, since it is possible to accurately control the movement of the recording medium M, it is possible to accurately position the recording medium M at the correct position to which the ink droplets are to be ejected. Therefore, as compared to the related art where the movement is corrected by detecting the movement amount with the rotary encoder and the like, since it is possible to considerably reduce an error to be included in the detection value of the actual movement amount, it is possible to remarkably improve the recording accuracy.

As described above, according to the disclosed inkjet recording device 10, it is possible to accurately detect the actual movement amount of the recording medium M without being influenced by the thickness variation, the slippage, the serpentine and the like of the recording medium M or the belt 30 configured to convey the recording medium M. Therefore, since it is possible to precisely correct the movement of the recording medium M on the basis of the detection value, it is possible to accurately position the recording medium M to which the ink is to be ejected from the inkjet heads 22, thereby making a record of a high image quality.

Also, in particular, the following characteristic operational effects are accomplished by the second illustrative embodiment.

The disclosed inkjet recording device 10 is the inkjet recording device having the recording heads 22 configured to eject the ink droplets and configured to make a record on the recording medium M by ejecting the ink droplets from the recording heads 22, wherein the inkjet recording device 10 includes the movement unit 31 configured to move the recording medium M or the placement part 30 configured to place the recording medium M thereon, the detection unit 40 configured to continuously detect the movement of the recording medium M or the placement part 30, and the control unit 28 configured to control the movement unit 31 and the detection unit 40, wherein the detection unit 40 includes the gripping unit 42 having the gripping part 44 configured to grip the recording medium M or the placement part 30 and the detection part 48 configured to continuously detect the movement of the gripping unit 42, wherein the gripping unit 42 is configured to move in conjunction with the movement of the recording medium M or the placement part 30 by gripping the recording medium M or the placement part 30 by the gripping part 44, and wherein the control unit 28 is configured to control the movement of the movement unit 31 on the basis of the detection result by the detection part 48 when the gripping unit 42 is moved.

According to the inkjet recording device, the gripping unit 42 is configured to grip the placement part 30 by the gripping part 44, so that the gripping unit 42 is moved in conjunction with the movement of the placement part 30. Therefore, the movement amount of the gripping unit 42 is continuously detected by the detection part 48, so that it is possible to accurately detect the movement amount of the placement part 30. Since it is possible to accurately position the recording medium M placed on the placement part 30 at the correct position by correcting and controlling the movement of the movement unit 31 on the basis of the detection value, it is possible to make a record of a high image quality.

In the meantime, the operational effects are not limited to the configuration where the recording medium M is conveyed with being placed on the placement part 30, and can also be accomplished when the recording medium M is directly conveyed without the placement part 30.

Also, according to the disclosure, the driving unit 35 that is configured to drive the movement unit 31 or the gripping unit 42, thereby generating the driving force for moving the placement part 30 is preferably provided. According to this configuration, it is possible to move the recording medium M or the placement part 30 by driving the movement unit 31 with the driving unit 35. Alternatively, the gripping unit 42 may be driven by the driving unit 35, and the recording medium M or the placement part 30 may be moved with being gripped by the gripping part 44.

Also, according to the disclosure, preferably, the movement unit 31 is the pair of rollers (the first roller 31A and the second roller 31B), and the placement part 30 is the belt put on the pair of rollers. According to this configuration, it is possible to move the belt 30 functioning as the placement part by driving the roller (here, the first roller 31A) functioning as the movement unit. That is, in a configuration where the gripping unit 42 is not driven, it is not necessary to make the structure of the gripping unit 42 as a robust and complicated structure in which the transmission of the driving force is premised. Therefore, the structure can be simplified. Further, if the gripping unit 42 is driven to move the belt 30, the belt slips due to the load at a part gripped by the gripping part 44, so that the detection accuracy may be lowered. However, according to the above configuration, the driving force of the driving unit 35 is transmitted to the movement unit 31 and the gripping unit 42 is configured to move in conjunction with the movement of the belt 30. That is, the driving configuration and the conjunction moving configuration can be functionally separated. Therefore, since the gripping unit 42 can be configured only to detect the movement amount without performing the driving, it is possible to improve the accuracy of the detection value.

In the meantime, the disclosure is not limited to the above illustrative embodiments, and can be variously changed without departing from the scope of the disclosure.

The invention claimed is:

1. An inkjet recording device having a recording head configured to eject ink droplets and configured to make a record on a recording medium by ejecting the ink droplets from the recording head, the inkjet recording device comprising:

a movement unit configured to move the recording medium or a placement part configured to place the recording medium thereon;

a detection unit configured to continuously detect movement of the recording medium or the placement part; and a control unit configured to control the movement unit and the detection unit, wherein the detection unit includes a gripping unit having a gripping part configured to grip the recording medium or the placement part and a detection part configured to continuously detect movement of the gripping unit, wherein the gripping unit is configured to move in conjunction with the movement of the recording medium or the placement part by gripping the recording medium or the placement part by the gripping part, and wherein the control unit is configured to control the movement of the movement unit on the basis of a detection result by the detection part when the gripping unit is moved.

2. The inkjet recording device according to claim 1, further comprising:

a driving unit that is configured to drive the movement unit or the gripping unit, thereby generating a driving force for moving the recording medium or the placement part.

3. The inkjet recording device according to claim 1, wherein the movement unit is a pair of rollers, and the placement part is a belt put on the pair of rollers.

4. The inkjet recording device according to claim 2, wherein the movement unit is a pair of rollers, and the placement part is a belt put on the pair of rollers.

5. The inkjet recording device according to claim 1, wherein the control unit controls the gripping unit to grip the recording medium or the placement part configured to place the recording medium thereon, when the recording medium or the placement part configured to place the recording medium thereon is moved by the movement unit.

6. The inkjet recording device according to claim 1, wherein the gripping part is arranged to be closely contacted and released in an upper and lower direction.

* * * * *